United States Patent [19]

Levasseur

[11] Patent Number: 4,609,792

[45] Date of Patent: Sep. 2, 1986

[54] ENCODING KEYBOARD

[75] Inventor: Joseph L. Levasseur, St. Louis, Mo.

[73] Assignee: Coin Acceptors, Inc., St. Louis, Mo.

[21] Appl. No.: 713,833

[22] Filed: Mar. 20, 1985

[51] Int. Cl.[4] ..... H01H 13/70

[52] U.S. Cl. ..... 200/5 A; 200/159 B; 340/365 R

[58] Field of Search ..... 200/5 A, 86 R, 159 B, 200/292, 340; 340/365 R

[56] References Cited

U.S. PATENT DOCUMENTS

| | | | |
|---|---|---|---|
| 4,347,504 | 8/1982 | Murofushi et al. | 200/5 A X |
| 4,450,324 | 5/1984 | Fukukura et al. | 200/5 A |
| 4,484,038 | 11/1984 | Durman et al. | 200/5 A |
| 4,490,587 | 12/1984 | Miller et al. | 200/5 A |

*Primary Examiner*—J. R. Scott

*Attorney, Agent, or Firm*—Haverstock, Garrett & Roberts

[57] ABSTRACT

An encoding keyboard construction comprising a common input lead, a plurality N of output leads, and a plurality Y of key locations, each of which key locations has associated therewith aligned first and second contact sites defining a contact site pair, which contact sites are biased apart but can be moved into engagement with one another to establish contact therebetween. Each contact side pair includes three electrodes, one of which electrodes is connected to the common input lead, and each contact site includes at most two electrodes, each of which electrodes is connected to a respective single output lead. The output leads are each respectively connected to one or more selected contact sites such that, for each actuation of a key location, contact is effected between the contact sites of the contact site pair associated with such key location, which contact effects application of the signal present on the common input lead to a distinct pair of output leads, thereby effecting production of a distinct 2-of-N multi-bit output signal representative of such key location.

24 Claims, 6 Drawing Figures

| Key | Contact Site Pair | Output 172 | 174 | 176 | 178 | 180 | 182 | | Common 184 |
|---|---|---|---|---|---|---|---|---|---|
| A/1 | 120 | X | | | | X | | | X |
| B/2 | 121 | X | | X | | | | | X |
| C/3 | 122 | X | | | | | X | | X |
| D/4 | 123 | X | | | X | | | | X |
| E/5 | 124 | | X | X | | | | | X |
| F/6 | 125 | | | X | | | X | | X |
| G/7 | 126 | | X | | X | | | | X |
| 8 | 127 | | | X | X | | | | X |
| H/9 | 128 | | | | X | | X | | X |
| * | 129 | X | X | | | | | | X |
| 10 | 130 | | | | X | X | | | X |
| # | 131 | | | | | X | X | | X |

ENCODING KEYBOARD

BACKGROUND OF THE INVENTION

The present invention relates to an encoding keyboard, and, more particularly, to a keypad that requires a minimal number of lead connections, yet which can generate, upon actuation of a keypad key location, a distinct encoded output signal that uniquely identifies the particular key location actuated.

DESCRIPTION OF RELATED ART

Over the years numerous keyboards and keypads of various types have been developed. One enduring and still prevalent type of keyboard construction, sometimes referred to as an SP/Common Bus construction, includes a plurality of output leads, each connected to a first contact site of a respective switching element, and a common lead connected to a second contact site of all of the switching elements, such that actuation of any selected switching element will result in the application of the signal value then present on the common lead to the particular output lead connected to such actuated switching element. While such constructions can be quite useful in many instances and in many applications, the use thereof in situations where a relatively large number of switching elements are either required or desired has often been considered disadvantageous since M output leads, plus one common input lead, are required, where M equals the total number of switching elements.

Other keyboard constructions which require fewer leads for a large number of switching elements have therefore been developed. One type of keyboard construction that has been found to significantly reduce, in most instances, the number of leads required is the matrix keyboard construction, which construction has been designed such that actuation of a specific key results in the generation of two output signals, one of which output signals indicates the row position and the other of which output signals indicates the column position of the actuated key location. Such matrix keyboard constructions require a number of output lead lines at least equal to R+C, where R represents the number of rows of key locations and C represents the number of columns of key locations on the keyboard. Depending upon the particular matrix layout employed, R+C will generally be significantly less than M+1 when M is a relatively large number. U.S. Pat. No. 4,484,039 discloses one construction of this matrix keyboard type, which construction comprises a keypad including a membrane switch assembly that has two sets of output lead lines, with each of the leads in one set interconnecting the key locations in a respective row of locations and each of the leads in the other set interconnecting the key locations in a respective column of locations. Another matrix keyboard construction is depicted in U.S. Pat. No. 4,484,038, which patent discloses a membrane touch panel that employs two sets of conductive strips disposed orthogonally to one another in two distinct spaced layers under the key locations, one set of strips being connectable to external circuitry to communicate thereto row information and the other set of strips being connectable to external circuitry to communicate thereto column information with regard to any key location actuated.

It will be appreciated that, with matrix keyboard constructions, the number of output leads is dependent to a great extent upon the particular matrix layout adopted. For example, if a matrix keyboard construction is to be employed and twenty (20) key locations are required, the matrix layout of the key locations, depending upon user requirements and desires, could be either a 4×5 or a 2×10 arrangement. In the former instance, a total of nine (9) output leads would be required, while in the latter instance, a total of twelve (12) output leads would be required. However, with either of such arrangements, the total number of leads required when a matrix keyboard construction is employed would still be significantly less than the twenty-one (21) leads that would be required for an SP/Common Bus keyboard construction.

As a result of attempts to reduce dependence upon the particular key location layout employed, other keyboard constructions have now been developed which produce distinctive encoded output signals upon key actuations. One such construction employs a typical 4×4 matrix keyboard in conjunction with an MC14419 2-of-8 keypad-to-binary encoder chip to generate encoded output signals that uniquely identify the particular key actuated. Although such construction produces encoded output signals, it requires both a matrix keyboard as a part thereof and substantial additional circuitry. Consequently, such construction has not proved desirable or advantageous in many instances, and other constructions that directly encode the output signal while minimizing the circuitry required and holding required output leads to a minimum have therefore been developed.

One of such encoding keyboard constructions is disclosed in U.S. Pat. No. 4,450,324, which patent is directed to a keypad assembly formed, in part, from a single, foldable sheet of flexible film that has electrodes disposed at contact sites on one of its surfaces, certain of which electrodes are connected to a common lead and selected others of which electrodes are interconnected with one another and with respective output leads in accordance with a predetermined encoding scheme. The film is folded to form four stacked sections with stacked sets of aligned electrodes disposed at each of the key locations and with one electrode of each set being connected to the common lead. Actuation of a specific key location results in the production of an encoded output signal when the electrodes within the selected stack of electrodes are moved into contact with one another. Although such construction, because of its encoding scheme, reduces the number of lead connections required, the particular embodiment depicted in U.S. Pat. No. 4,450,324 requires that, for certain key actuations, contact be established between the common lead and three other leads by way of a plurality of switch electrodes disposed in up to four (4) layers with, in some instances, two (2) electrodes disposed in a single layer, in order to produce an appropriate encoded output signal representative of the key location actuated. The establishment of good contact between such considerable number of electrodes is not without mechanical and operational difficulties. Clearly, as the number of key locations on the keyboard increases, such difficulties become more severe, and increasingly difficult design and layout problems problems are encountered.

The present invention alleviates or overcomes many of the problems and difficulties attendant to the known keyboard constructions, and does so by directly producing, in response to actuation of a selected key location, a 2-of-N encoded output signal, where N is the number of output leads required for the number of key locations employed. Because the 2-of-N encoding scheme results in a constant ratio code output for each value of N, i.e., because each actuation of a key location will result in the production of an N-bit output signal two and only two of whose bits will be affected by any individual key location actuation, the present invention, unlike many prior art keyboard constructions that generate encoded outputs, can conveniently be utilized in conjunction with simple bit count and parity-type check means to permit the rapid and convenient detection of simultaneous actuations of more than one key location. With many of the other encoding keyboard constructions, such determinations simply cannot be made from an examination of the output signal. With other encoding keyboard constructions, such determinations, while not impossible, cannot be easily or economically accomplished since significant and complex additional circuitry would be required.

The ability to detect multiple key location actuations is highly important in the vending industry, where keyboard constructions of various types are increasingly being utilized as vend selection means. On occasions, customers may try to cheat vending systems by attempting to actuate simultaneously, or in a rapid or patterned succession, more than one vend selection key or key location. It is important, in such instances, to be able to distinguish the outputs produced in response to simultaneous actuations of multiple key locations from the encoded outputs produced in response to actuation of any single key location. With the present invention such distinguishability is not only possible, but can be easily effected through the use of external bit counting and parity-type check means. Furthermore, because the number of output leads required for a given number of key locations is held to a miminal level in the present invention, as has already been discussed hereinbefore, such invention can be readily and advantageously incorporated into vending systems in place of other known vend selection means.

SUMMARY OF THE INVENTION

The present invention comprises a common input lead, a plurality N of output leads, and a plurality Y of key locations in a keyboard construction, each of which key locations has associated therewith aligned first and second contact sites defining a contact site pair, which contact sites are biased apart but can be moved into engagement with one another to establish contact therebetween. Each contact site pair includes three electrodes, one of which electrodes is connected to the common input lead, and each contact site includes at most two electrodes, each of which electrodes is connected to a respective single output lead. The output leads are each respectively connected to one or more selected contact sites such that, for each actuation of a key location, contact is effected between the contact sites of the contact site pair associated with such key location, which contact effects application of the signal present on the common input lead to a distinct pair of output leads, thereby effecting production of a distinct 2-of-N multi-bit output signal representative of such key location.

The preferred embodiment of a keyboard construction that includes the present invention is a keypad construction comprising a stacked assembly including, in top to bottom order, a key location indicator means, a first membrane sheet member, an insulating member, a second membrane sheet member, and a backing member. A plurality of electrodes or switch contacts are disposed at contact sites on opposed faces of the first and second sheet members, both of which members may typically be transparent or translucent, and such electrodes on the second sheet member are positioned to be in alignment with certain of the electrodes on the first sheet member such that each contact site pair has three electrodes and each contact site includes at most two electrodes. A common input lead is connected, through conductors disposed on the opposed faces of the sheet members, to one electrode of each contact site pair, and a plurality of output leads are connected, through conductors disposed on one or both the opposed faces of the sheet members, to the respective electrodes of one or more selected contact sites, with each electrode at a contact site being connected to a single conductor and the electrodes of each contact site pair being connected through the conductors to a distinctive respective pair of output leads. The noted insulating member is disposed between the sheet members and has a plurality of openings therethrough which are located in alignment with the contact site pairs on the sheet members so as to permit the electrodes forming each contact site pair to be moved into engagement with one another.

The key location indicator includes indicia upon the upper face thereof positioned in alignment with and above the contact site pairs to indicate the locations thereof. When downward pressure is applied at a marked key location, such as by a user pressing such location, the contacts thereunder in the stacked assembly are moved into contact with one another through an opening in the insulating member. For each key location, such action effects the application of the signal on the common input lead to a distinctive pair of output leads, thus producing a 2-of-N encoded output signal, which signal is uniquely representative of the particular key location pressed. As will be obvious to those skilled in the art, the present invention can also be readily incorporated into other embodiments, such as into devices using pushbutton technology instead of membraneous devices, and the same basic advantages can be realized with such devices as are realized with the preferred embodiment.

The number of output leads that will be required for any keyboard construction constructed according to the present invention can be determined by solving for N the equation $N(N-1) \geqq 2Y$, where N is the number of output leads required and Y is the number of key locations desired. Such equation is essentially a reformulation, when $Y \leqq X$, of the well known statistical equation $X=N!/[(N-2)!2!]$, where X is the maximum number of key locations possible for N output leads taken two and only two at a time. By way of example, if only two (2) key locations are desired, three (3) output leads must be provided; if three (3) to six (6) key locations are desired, four (4) output leads must be provided; if seven (7) to ten (10) key locations are desired, five (5) output leads must be provided; if eleven (11) to fifteen (15) key locations are desired, six (6) output leads must be provided; and so on. Since the present invention requires a common lead in addition to the output leads, it will be apparent that, for Y number of key locations, where $Y \leqq X$, the total number L of leads required for the present invention is therefore $N+1$, where N is determined by solving the equation $N(N-1) \geqq 2Y$.

The present invention, unlike the matrix keyboard constructions discussed previously, is therefore essentially independent of the particular key location layout employed. Many different key location layouts can be employed without effecting any change in the numbers of leads required. For example, if twenty (20) key locations are needed, a keyboard construction constructed according to the present invention would require seven (7) output leads plus one (1) common lead, for a total of eight (8) leads, whereas a matrix keyboard construction using row and column encoding would require nine (9) output leads if the key locations are laid out in a 5×4 array and twelve (12) output leads if the key locations are laid out in a 2×10 array.

It is therefore a principal object of the present invention to provide a keyboard construction that is capable of producing a distinct 2-of-N encoded output signal for each different key location actuated.

Another object is to provide a keyboard construction that requires a minimal number of output leads and that is capable of producing a constant ratio code output signal from which it can readily be determined if two or more key locations have been actuated simultaneously.

A further object is to provide a keyboard construction, the number of output leads of which is essentially independent of the particular key location layout utilized for a given number of key locations.

Another object is to provide an encoding keyboard construction that permits the use therewith of external bit counting and/or parity-type check means to check the encoded output of the keyboard construction and to determine if a valid output signal has been produced.

These and other objects and advantages of the present invention will become apparent to those skilled in the art after considering the following detailed specification in conjunction with the accompanying drawings, wherein:

DESCRIPTION OF THE PREFERRED EMBODIMENT

Figure 1:
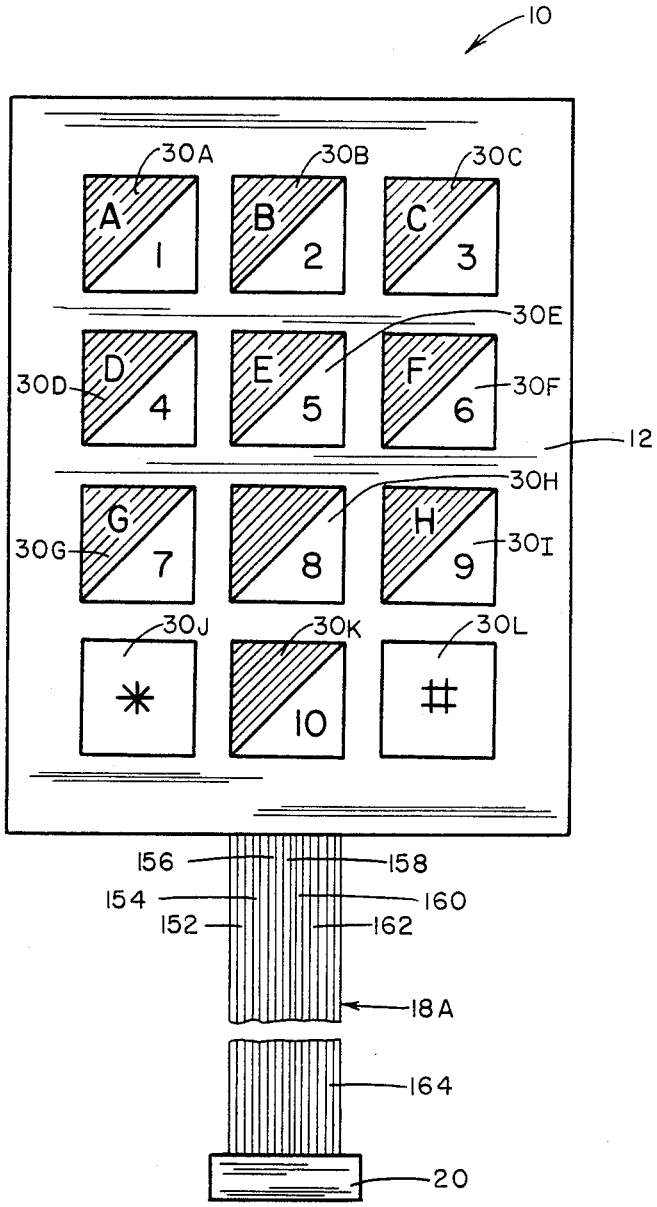
FIG. 1 is a top view of a preferred twelve key keypad embodiment of the present encoding keyboard, showing a preferred marking for the keypad face.

Referring now to the drawings more particularly by reference numbers, wherein like numbers refer to like items, number 10 refers to an encoding keypad construction comprising a stacked assembly 11 (FIG. 2), including keypad facing member 12, membrane sheet members 14 and 15, insulating member 16, and backing member 17, along with dual tail portions 18A and 18B, and connector means 20. Keypad facing member 12, which is the topmost element in stacked assembly 11, has marked thereon a plurality of key locations 30A–30L (FIG. 1), which key locations mark the positions of underlying contact sites on the sheet members 14 and 15. The key locations 30A–30L may be marked or designated by any appropriate indicia, including numerals, letters, and/or symbols to designate user operable key means at such locations. By way of example, key location 30A is designated by both the letter A and the numeral 1; key location 30H is designated by the numeral 8; and key location 30J is designated by the symbol *.

Figure 4:
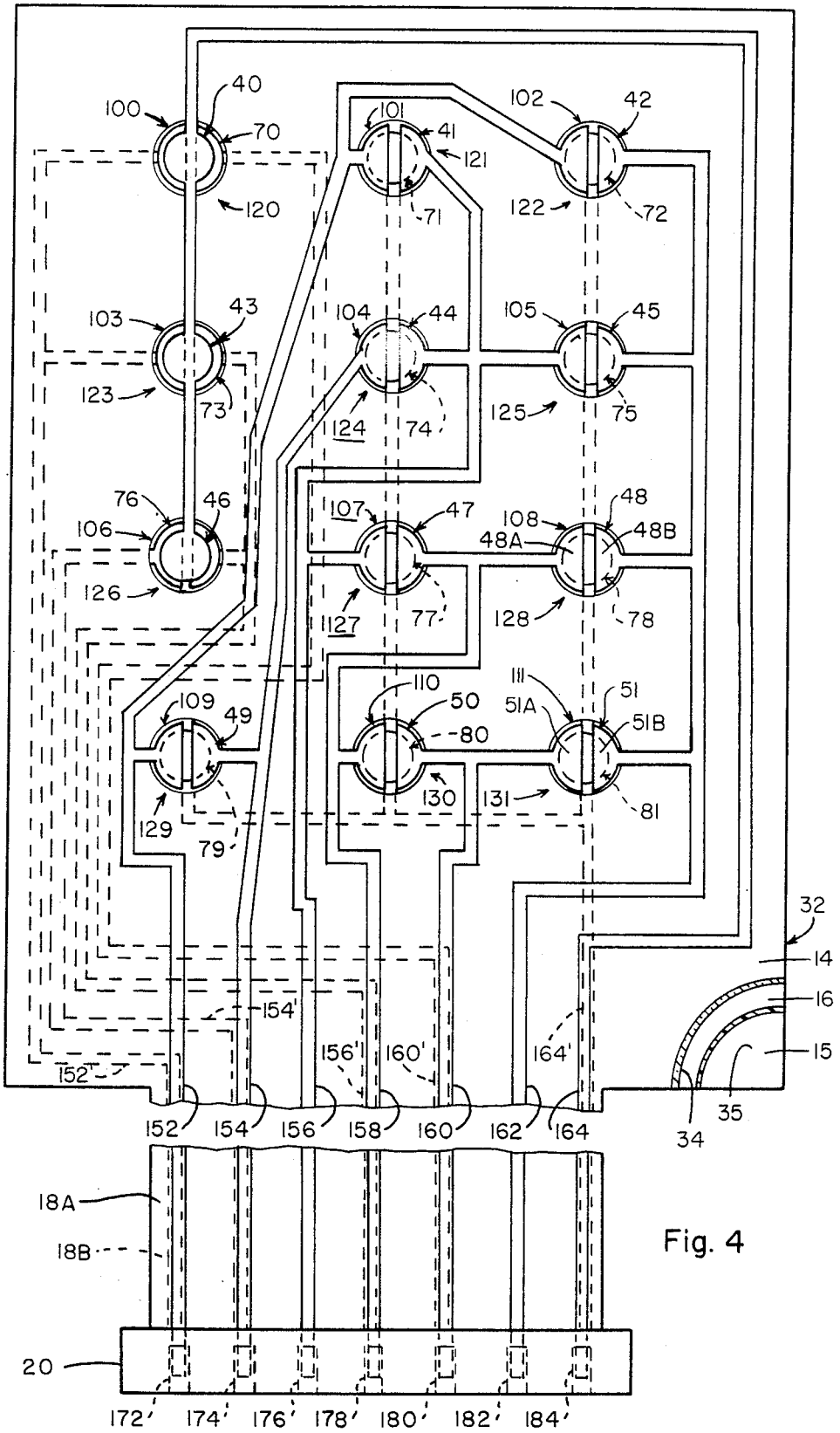
FIG. 4 is a diagram depicting a preferred layout of the conductors and switch contacts on the spaced membrane sheet members of the preferred embodiment.

Positioned beneath keypad facing member 12 in the stacked assembly 11 is subassembly 32 which includes in an ordered, stacked arrangement first sheet member 14, insulating member 16, and second sheet member 15, which sheet members have disposed on their respective opposed faces 34 and 35 pluralities of contact sites and pluralities of conductors interconnecting selected ones of such contact sites. FIG. 4 depicts in detail, and in overlay fashion, a preferred layout of the circuitry of the preferred embodiment, with a portion of the underlying circuitry that is disposed on sheet member 15 being shown in dotted outline. It will be appreciated that FIG. 4 is a representational figure and that certain elements depicted thereon, or their positions or dimensions, may be shown in modified or exaggerated form in such figure for the sake of clarity in explanation and reference. Numbers 40–51 identify respective contact sites on sheet member 14 and numbers 70–81 identify corresponding respective contact sites on sheet member 15, which corresponding respective contact sites on sheet member 15 are in alignment with the respective contact sites on sheet member 14 and with holes 100–111 in the insulating member 16. It will be appreciated that the aligned contact sites on sheet members 14 and 15 define respective contact site pairs 120–131. Thus, contact site pair 131 includes contact site 51 disposed on surface 34 of sheet member 14 and contact site 81 disposed on surface 35 of sheet member 15. It may be observed that some of the contact sites on each of the sheet members include two independent contact elements or electrodes while other contact sites have only a single electrode. For example, contact site 51 includes contact elements 51A and 51B, each of which electrodes are of essentially semi-circular configuration as depicted in FIG. 4, but contact site 81 includes only a single electrode of substantially circular configuration.

Sheet member 14 includes a first set of conductors 152–164 disposed thereon on surface 34, each of which conductors is connected to one or more selected contact sites on sheet member 14. A second set of conductors 152', 154', 158', 160', and 164' are disposed on surface 35 of sheet member 15, each of which conductors is connected to one or more selected contact sites on sheet member 15. The first set of conductors extends from sheet member 14 onto tail portion 18A and the second set of conductors extends from sheet member 15 onto tail portion 18B, which tail portions are connected to connector means 20 such that conductors 152 and 152' are connected to lead connection 172, conductors 154 and 154' are connected to lead connection 174, conductor 156 is connected to lead connection 176, conductors 158 and 158' are connected to lead connection 178, conductors 160 and 160' are connected to lead connection 180, conductor 162 is connected to lead connection 182, and conductors 164 and 164' are connected to lead connection 184.

As may be observed from FIG. 4, conductor 164 is connected to contact sites 40, 43, and 46 on sheet member 14 and conductor 164' is connected to contact sites 71, 72, 74, 75, 77, 78, and 79–81 on sheet member 15. Thus, in the preferred embodiment, all of the contact site pairs include a contact site connected either to conductor 164 or conductor 164', both of which conductors are connected to lead connection 184 of connector 20. It will thus be appreciated that lead connection 184 is intended to be a common input connection and that conductors 164 and 164' are intended to provide the common signal applied to lead connection 184 to one contact site of each of the contact site pairs 120–131. The remaining lead connections 172–182, which are connected in the manner described hereinabove to the various conductors disposed on sheet members 14 and 15, are intended to be output connections at which bit signals are produced, the combination of which bit signals is an encoded output signal identifying which, if any, key location has been actuated.

Figures 5, 6:
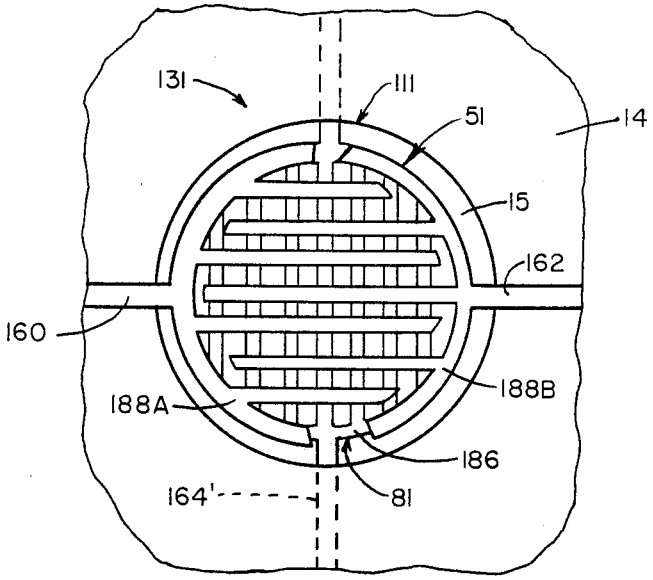
FIG. 5 is a table indicating the correspondences existing between key locations of the preferred embodiment and the outputs by actuations of such key locations.
FIG. 6 is an enlarged view of a typical contact site pair, showing an alternate embodiment for the contacts forming the contact site pair.

It should be noted that each contact site, whether disposed on sheet member 14 or sheet member 15, has at most two electrodes thereat, and that each electrode at an individual contact site is connected to a single, respective conductor. Further, each contact site pair includes three and only three electrodes, one of which three electrodes is operatively connected to the common input connection 184 through one of the conductors 164 or 164', as has already been described. The other two electrodes in each contact site pair are connected to two distinct conductors and, therethrough, to two distinct output connections, which pair of distinct output connections is unique for each contact site. For example, contact site pair 131 includes contact site 81 on sheet 15, which contact site is a single electrode connected through conductor 164' to input connection 184, and contact site 51 on sheet member 14, which contact site includes electrode 51A connected through conductor 160 to output lead connection 180 and electrode 51B connected through conductor 162 to output lead connection 182, whereas contact site pair 128 includes contact site 78 on sheet member 15, which contact site is a single electrode connected through conductor 164' to input connection 184, and contact site 48 on sheet 14, which contact site includes electrode 48A connected through conductor 158 to output connection 178 and electrode 48B connected through conductor 162 to output connection 182. FIG. 5 clearly indicates the operative connections that are employed between contact site pairs 120–131 and output connections 172–182 in the preferred embodiment, which connections are clearly illustrated in FIG. 4.

It will be appreciated by those skilled in the art that, when a common input signal is supplied to common input connection 184 of connector 20, and a key location 30A–30L on keypad facing member 12 is depressed, the underlying aligned contact sites forming the associated contact site pair in the stacked assembly 11 will be moved into contact with one another through a hole in the insulating member 16, thereby effecting application of the common input signal to a distinct pair of output connections at connector means 20. For example, if the # symbol at location 30L on keypad facing member 12 is pressed, electrodes 51A and 51B lying thereunder will be moved into contact with the electrode at contact site 81 through hole 111 in insulating member 16, thereby resulting in application of the common input signal to both of electrodes 51A and 51B and the consequent communication of such common signal over respective conductors 160 and 162 to respective output connections 180 and 182. As will be apparent from an examination of FIG. 5, the composite signal produced at output connections 172–182 in response to the actuation of any single key location will be an encoded output signal which uniquely identifies tne particular key location actuated, which output signal, in the present instance, will be a 2-of-6 encoded output signal.

From what has been said hereinbefore, it will be recognized that the preferred embodiment, which employs twelve (12) key locations, has required six (6) output lead connections to be able to produce a 2-of-6 encoded output signal. Keyboard constructions employing greater or lesser numbers of key locations can also be readily constructed according to the present invention so as to be capable of producing 2-of-N encoded output signals. As has previously been explained, the value of N for any particular construction will be dependent upon the number of key locations desired. Thus, if between 11 and 15 key locations are desired, a keyboard construction constructed according to the present invention must have six (6) output leads to be able to produce a 2-of-6 encoded output signal. Similarly, if 16 through 21 key locations are desired, the keyboard construction must have seven (7) output leads to be able to produce a 2-of-7 encoded output signal; if 21 through 28 key locations are desired, the keyboard construction must have eight (8) output leads to be able to produce a 2-of-8 encoded output signal; and so on.

By employing such 2-of-N encoding techniques, contacts need be established at each key location in response to actuation of such key location only between a common electrode and two other electrodes, as a consequence of which mechanical and operational difficulties in establishing multiple contacts at any particular key location can be held to a minimum. If more sheet members having aligned contact sites thereon were to be required, or if more than two electrodes were to be required at a contact site on any sheet member, the possibility of encountering problems due to poor contact between the multiple electrodes at such key location, or due to the failure or inability to establish good contact, would be significantly increased. Although it has been found that, so long as no more than two electrodes are required at any contact site, good results can generally be obtained over an extended period of use of the keyboard construction, it is nevertheless recognized that whenever two or more contacts must be made, there is always some possibility that difficulties could arise. For example, it is possible, though unlikely, that, with the particular contact site configuration depicted in FIG. 3, pressure could be applied to a particular key location in such a manner that contact would be established between the contact site connected to the common input and one, but not both, of the electrodes disposed at the other contact site. In some instances, it may therefore be desirable to employ other contact site configurations which might further obviate any possibility of difficulties in the establishment of good contact between the contact site connected to the common input and the two electrodes at the other contact site.

Figures 2, 3:
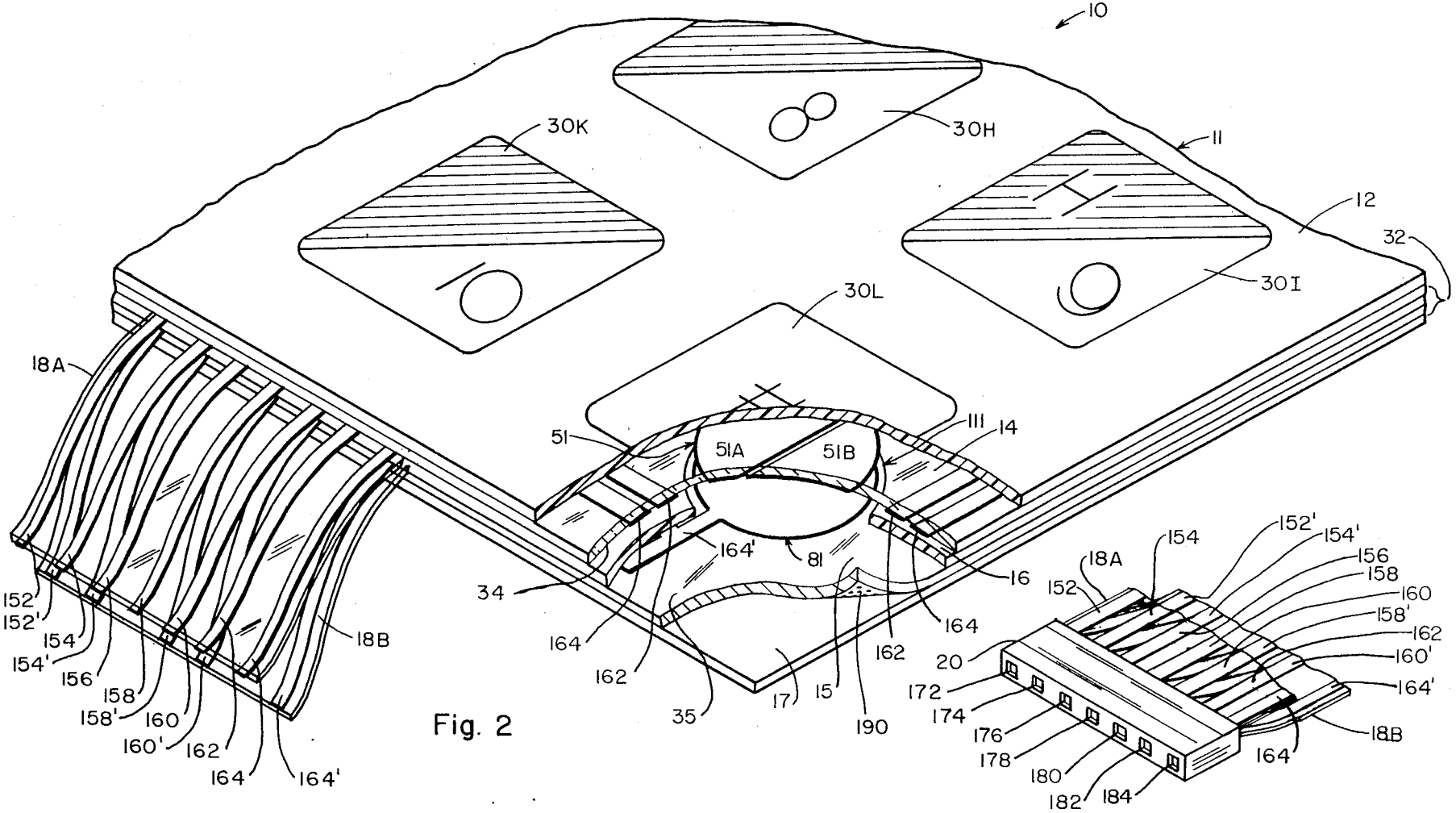
FIG. 2 is a greatly enlarged, fragmentary, perspective view, partly in cutaway, of the preferred embodiment of FIG. 1.
FIG. 3 is an enlarged, perspective view of a typical connector that may be utilized with the preferred embodiment.

FIG. 6 depicts, in use at one of the contact sites in a contact site pair, a set of electrodes of alternate construction. Such set of electrodes is shown employed at contact site pair 131, with electrode 186 being employed at contact site 81 on sheet member 15 and electrodes 188A and 188B being employed at contact site 51 on sheet member 14. Electrode 186, which is employed in place of the essentially circular electrode disposed at contact site 81 in FIG. 3, is of an essentially circular configuration and includes a peripheral conducting band encircling a non-conductive interior and a plurality of spaced parallel conducting chords that extend across such interior and are connected at their ends to the peripheral conducting band. Electrodes 188A and 188B, which are employed in place of the essentially semi-circular electrodes 51A and 51B disposed at contact site 51 in FIG. 3, are both of similar design, each having a plurality of spaced, parallel conducting tines extending from a generally semi-circular conducting band. In the FIG. 6 embodiment, electrodes 188A and 188B are shown disposed at contact site 51 with their conducting tines interleaved with one another and with such conducting tines disposed in orthogonal relationship to the spaced, parallel conducting chords of aligned electrode 186. It will be recognized that the overall surface areas of such electrodes are smaller than the surface areas of the electrodes depicted in FIG. 3. However, due to the interleaving of the conducting tines of electrodes 188A and 188B, the possibility of effecting a contact between contact site 81, which is connected to the common input, and one, but not both, of the electrodes 188A and 188B, is greatly reduced.

It should be noted that although the present invention has been described in terms of the preferred membraneous embodiments depicted in the accompanying drawings, such invention could similarly be embodied in other keyboard and keypad technologies. By way of example, and not by way of limitation, it should be noted that in some embodiments of the claimed invention a plurality of operable key elements, which could take the form of pushbutton actuator means in one embodiment, could be provided, with each of the key elements being associated with a contact site pair and being operable by a user to effect electrical connection between the electrodes of such contact site pair, such as by way of a conductive element associated with or included as a part of such operable key element or by the movement of the contact sites defining such contact site pair into contact with one another.

It will be also appreciated that the keyboard keypad constructions constructed according to the present invention may be designed to include means therewith for mounting such constructions at desired locations. Typically, as in the preferred embodiment, the mounting means will take the form of an adhesive material 190, such as a pressure sensitive coating, applied to the backside of sheet member 15 and covered by a protective backing, such as backing member 17. With such mounting means, when installation of the keypad construction is desired, an installer simply peels the protective backing member 17 off the construction, positions such construction at the desired location, and applies pressure thereto in order to adhesively attach the construction to the underlying material at such location. It will be recognized, however, that many other types of mounting means, such as mounting studs attached to the keyboard construction, could be equally as well employed, and that the backing members utilized with various keyboard constructions may be used for other purposes, such as to provide a rigid backing, instead of as protective coverings for pressure sensitive adhesives, and need not necessarily be removed before installation of such constructions at their desired locations.

From all that has been said hereinbefore, it will be appreciated that, although the present invention, and especially the preferred embodiment thereof, has been designed for and is being advantageously employed in various vending applications, such invention can also be readily utilized in many other applications and with various other technologies not discussed herein, and numerous modifications thereto and variations thereof are possible and contemplated. In this regard, and by way of example, it may be noted that, in many applications, output pins or various types of connectors or other types of termination means, including means directly mounted upon or attached to circuit boards or pads, could be appropriately and advantageously employed in place of the tail portions and associated connector utilized with the preferred embodiment. Many other modifications and alterations, too numerous to mention, could likewise be similarly effected.

There has thus been shown and described a novel encoding keyboard which fulfills all of the objects and advantages sought therefor. It will be apparent to those skilled in the art, however, that many changes, modifications, variations, and other uses and applications of the subject encoding keyboard are possible and contemplated. All such changes, modifications, variations, and other uses and applications which do not depart from the spirit and scope of this invention are deemed to be covered by the invention, which is limited only by the claims which follow.

What is claimed is:

1. An encoding keyboard construction comprising an input connection, a plurality N of output connections, where N is an integer, a plurality of first contact sites, a plurality of second contact sites, each of said second contact sites being associated with a respective first contact site to define a contact site pair, each contact site pair including three electrodes, each contact site including at most two electrodes, a first set of conductors each of which conductors is connected to a single selected electrode at each of one or more selected contact sites of said first contact sites, a second set of conductors each of which is connected to a single selected electrode at each of one or more selected contact sites of said second contact sites, at least one of said conductors being connected to said input connection for receiving a common input signal and the remainder of said conductors being connected to said plurality of output connections, means biasing said first contact sites apart from said second contact sites, one of said electrodes of each contact site pair being operatively connected to said input connection, the other two electrodes of each contact site pair being operatively connected to two distinct output connections which define a pair of output connections associated with such contact site pair, said pair of output connections associated with each contact site pair being unique to such contact site pair, said contact sites that define each contact site pair being adapted to be moved into contact with one another, the establishment of contact between the contact sites that define each contact site pair effecting application of the common input signal to the unique pair of output connections associated with such contact site pair and thereby effecting production at said plurality of output connections of an encoded 2-of-N multi-bit output signal uniquely representative of such contact site pair.

2. The encoding keyboard construction of claim 1 including first and second sheet-like members each having a first face, said plurality of first contact sites disposed on said first face of said first sheet-like member, said plurality of second contact sites disposed on said first face of said second sheet-like member, said contact sites on said second sheet-like member being spaced thereon to be in alignment with said contact sites on said first sheet-like member when said first faces of said sheet-like members are positioned in face-to-face relationship.

3. The encoding keyboard construction of claim 2 wherein said first set of conductors is disposed on said first sheet-like member and said second set of conductors is disposed on said second sheet-like member.

4. The encoding keyboard construction of claim 2 wherein said first set of conductors is disposed on said first face of said first sheet-like member and said second set of conductors is disposed on said first face of said second sheet-like member.

5. The encoding keyboard construction of claim 2 wherein said biasing means includes insulating means disposed between said first faces of said sheet-like members.

6. The encoding keyboard construction of claim 5 wherein said insulating means includes a sheet-like insulating member having holes therethrough in alignment with said aligned contact sites on said first and second sheet-like members.

7. The encoding keyboard construction of claim 5 including key location indicator means, said first sheet-like member having a second face, said key location indicator means being positioned adjacent said second face of said first sheet-like member, said key location indicator means including a plurality of means for marking the positions of respective contact site pairs.

8. The encoding keyboard construction of claim 7 wherein said marking means include depressible members having means therewith for effecting contact between the contact sites defining the contact site pairs whose positions are marked by said marking means.

9. The encoding keyboard construction of claim 7 wherein said key location indicator means is a keypad facing member and said marking means are indicia disposed on said keypad facing member.

10. The encoding keyboard construction of claim 5 including means for mounting said construction at a desired location.

11. The encoding keyboard construction of claim 10 wherein said second sheet-like member has a second face and said mounting means includes an adhesive material applied to said second face of said second sheet-like member.

12. The encoding keyboard construction of claim 11 wherein said mounting means further includes a removable backing member covering said adhesive material applied to said second face of said second sheet-like member.

13. The encoding keyboard construction of claim 2 including tail means, said tail means including a plurality of conductors thereon each connected between one of said input and output connections and one of said conductors of said first and second sets of conductors.

14. The encoding keyboard construction of claim 13 including connector means, said input and output connections located on said connector means.

15. The encoding keyboard construction of claim 2 wherein said input and output connections include pin members connected to said conductors.

16. The encoding keyboard construction of claim 2 wherein tne number of contact site pairs is equal to Y and $Y \leqq N!/[(N-2)!2!]$.

17. The encoding keyboard construction of claim 2 wherein said first and second sheet-like members are transparent membrane panels.

18. The encoding keyboard construction of claim 2 wherein said first and second sheet-like members are portions of a single folded sheet of flexible film-like material.

19. The encoding keyboard construction of claim 2 wherein said sheet-like members each have tail extensions, each of said tail extensions having one or more conductor extensions disposed thereon, each of said conductor extensions connected between one of said input and output connections and one of the conductors of said first and second set of conductors.

20. The encoding keyboard construction of claim 1 wherein said means biasing said first contact sites apart from said second contact sites includes spacer means.

21. An encoding keyboard construction comprising an input connection, a plurality N of output connections where N is an integer, a plurality of first contact sites, a plurality of second contact sites, each of said second contact sites being associated with a respective first contact site to define a contact site pair, each contact site pair including three electrodes, each contact site including at most two electrodes, a first set of conductors each of which conductors is connected to a single selected electrode at each of one or more selected contact sites of said first contact sites, a second set of conductors each of which is connected to a single selected electrode at each of one or more selected contact sites of said second contact sites, at least one of said conductors being connected to said input connection for receiving a common input signal and the remainder of said conductors being connected to said plurality of output connections, said first contact sites spaced apart from said second contact sites, one of said electrodes of each contact site pair being operatively connected to said input connection, the other two electrodes of each contact site pair being operatively connected to two distinct output connections which define a pair of output connections associated with such contact site pair, said pair of output connections associated with each contact site pair being unique to such contact site pair, and key means operable by a user to establish an electrical connection between the contact sites that define each contact site pair, the establishment of an electrical connection between the contact sites that define each contact site pair effecting application of the common input signal to the unique pair of output connections associated with such contact site pair and thereby effecting production at said plurality of output connections of an encoded 2-of-N multi-bit output signal uniquely representative of such contact site pair.

22. The encoding keyboard construction of claim 21 wherein said key means includes first and second sheet-like members, biasing means, and key location indicator means, each sheet-like member having a first face, said plurality of first contact sites disposed on said first face of said first sheet-like member, said plurality of second contact sites disposed on said first face of said second sheet-like member, said contact sites on said second sheet-like member being disposed thereon to be in alignment with said contact sites on said first sheet-like member when said sheet-like members are positioned in a face-to-face relationship, said biasing means normally maintaining said first contact sites spaced apart from said second contact sites, said key location indicator means including a plurality of means for marking the positions of respective contact site pairs, said contact sites that define each contact site pair being adapted to be moved into contact with one another to establish an electrical connection therebetween when a user applies pressure to said key means at a contact site pair position.

23. The encoding keyboard construction of claim 22 wherein said biasing means includes spacer means interposed between said first faces of said sheet-like members.

24. The encoding keyboard construction of claim 23 wherein said spacer means includes a sheet-like member having holes therethrough in alignment with said aligned contact sites on said first and second sheet-like members.

* * * * *

UNITED STATES PATENT OFFICE

CERTIFICATE OF CORRECTION

Patent No. 4,609,792 Dated September 2, 1986

Inventor(s) Joseph L. Levasseur

It is certified that error appears in the above-identified patent and that said Letters Patent are hereby corrected as shown below:

Column 5, line 54, insert the word "effected" before the words -- by actuations --.

Column 8, line 7, change the word "tne" to the word -- the --.

Column 9, line 47, insert the word "and" between the words -- keyboard keypad --.

Column 12, line 5, change the word "tne" to the word -- the --.

Signed and Sealed this

Twenty-fifth Day of November, 1986

*Attest:*

DONALD J. QUIGG

*Attesting Officer* *Commissioner of Patents and Trademarks*